US009951611B2

(12) United States Patent
Logan et al.

(10) Patent No.: US 9,951,611 B2
(45) Date of Patent: Apr. 24, 2018

(54) DOWNHOLE TELEMETRY

(71) Applicant: Evolution Engineering Inc., Calgary (CA)

(72) Inventors: Aaron W. Logan, Calgary (CA); David A. Switzer, Calgary (CA); Jili Liu, Calgary (CA); Justin C. Logan, Calgary (CA)

(73) Assignee: Evolution Engineering Inc., Calgary (CA)

( * ) Notice: Subject to any disclaimer, the term of this patent is extended or adjusted under 35 U.S.C. 154(b) by 3 days.

(21) Appl. No.: 15/481,300

(22) Filed: Apr. 6, 2017

(65) Prior Publication Data

US 2017/0211379 A1 Jul. 27, 2017

Related U.S. Application Data

(63) Continuation of application No. 14/189,901, filed on Feb. 25, 2014.

(60) Provisional application No. 61/768,936, filed on Feb. 25, 2013.

(51) Int. Cl.

| | |
|---|---|
| ***E21B 47/00*** | (2012.01) |
| ***E21B 47/12*** | (2012.01) |
| ***E21B 47/18*** | (2012.01) |
| *E21B 47/024* | (2006.01) |
| *E21B 49/00* | (2006.01) |
| *E21B 47/06* | (2012.01) |

(52) U.S. Cl.
CPC ..... *E21B 47/122* (2013.01); *E21B 47/18* (2013.01); *E21B 47/024* (2013.01); *E21B 47/06* (2013.01); *E21B 49/00* (2013.01)

(58) Field of Classification Search
CPC ..... E21B 47/12; E21B 47/18; E21B 47/122; E21B 47/182; E21B 47/185; E21B 47/187
USPC ..... 340/854.6, 12.2
See application file for complete search history.

(56) References Cited

U.S. PATENT DOCUMENTS

| | | | |
|---|---|---|---|
| 4,945,761 | A | 8/1990 | Lessi et al. |
| 6,144,316 | A | 11/2000 | Skinner |
| 6,188,222 | B1 | 2/2001 | Seydoux et al. |
| 6,391,184 | B1 | 5/2002 | Orolin et al. |
| 6,405,136 | B1 | 6/2002 | Li et al. |
| 6,902,414 | B2 | 6/2005 | Dopf et al. |

(Continued)

FOREIGN PATENT DOCUMENTS

| | | | |
|---|---|---|---|
| CA | 2617328 | A1 | 8/2003 |
| CA | 2666695 | A1 | 10/2007 |

(Continued)

OTHER PUBLICATIONS

National Oilwell Varco Blackstar EMWD brochure, Apr. 23, 2007.

(Continued)

*Primary Examiner* — Steven Lim
*Assistant Examiner* — Mancil Littlejohn, Jr.
(74) *Attorney, Agent, or Firm* — Oyen Wiggs Green & Mutala LLP

(57) ABSTRACT

A telemetry system with a plurality of controllers and telemetry systems, where the controllers are configured to obtain information from one or more sensors and transmit that information on one or more of the plurality of telemetry systems. The configuration of a controller may be changed so as to change which information is transmitted on a given telemetry system.

4 Claims, 5 Drawing Sheets

(56) References Cited

U.S. PATENT DOCUMENTS

| | | | |
|---|---|---|---|
| 6,909,667 | B2 | 6/2005 | Shah et al. |
| 7,163,065 | B2 | 1/2007 | Zhang et al. |
| 7,348,894 | B2 | 3/2008 | Bailey et al. |
| 7,462,957 | B2 | 12/2008 | Camwell et al. |
| 7,552,761 | B2 | 6/2009 | Moriarty |
| 7,565,936 | B2 | 7/2009 | Zhang et al. |
| 7,573,397 | B2 | 8/2009 | Petrovic et al. |
| 7,839,719 | B2 | 11/2010 | Dopf et al. |
| 7,880,640 | B2 | 2/2011 | Lovell et al. |
| 7,881,802 | B2 | 2/2011 | Quiles et al. |
| 7,894,302 | B2 | 2/2011 | Aiello et al. |
| 7,994,932 | B2 | 8/2011 | Huang et al. |
| 8,120,509 | B2 | 2/2012 | Young |
| 8,154,420 | B2 | 4/2012 | Petrovic et al. |
| 8,483,849 | B2 | 7/2013 | Recknagel et al. |
| 2003/0151977 | A1 | 8/2003 | Shah et al. |
| 2004/0100393 | A1 | 5/2004 | Sun et al. |
| 2006/0132335 | A1 | 6/2006 | Kojima |
| 2006/0198242 | A1 | 9/2006 | Geerits et al. |
| 2007/0247328 | A1 | 10/2007 | Petrovic et al. |
| 2008/0095166 | A1 | 4/2008 | Wiemann et al. |
| 2008/0136665 | A1 | 6/2008 | Aiello et al. |
| 2009/0038851 | A1 | 2/2009 | Camwell et al. |
| 2009/0045973 | A1 | 2/2009 | Rodney et al. |
| 2009/0115625 | A1 | 5/2009 | Young |
| 2009/0120689 | A1 | 5/2009 | Zaeper et al. |
| 2010/0098045 | A1 | 4/2010 | Miyazaki |
| 2010/0194586 | A1 | 8/2010 | Tjhang et al. |
| 2010/0201540 | A1* | 8/2010 | Li ..... E21B 47/12 340/853.1 |
| 2012/0085583 | A1 | 4/2012 | Logan et al. |
| 2012/0256759 | A1 | 10/2012 | Petrovic et al. |
| 2013/0134304 | A1 | 5/2013 | Beekman et al. |
| 2013/0192357 | A1 | 8/2013 | Ramshaw et al. |
| 2015/0167392 | A1 | 6/2015 | Sugiura |

FOREIGN PATENT DOCUMENTS

| | | | |
|---|---|---|---|
| CA | 2624039 | A1 | 9/2008 |
| CA | 2584671 | C | 2/2009 |
| CA | 2544457 | C | 7/2009 |
| CA | 2633904 | C | 8/2009 |
| CA | 2634236 | C | 8/2009 |
| MX | 2010008773 | A | 2/2011 |
| WO | 2010121344 | A1 | 10/2010 |
| WO | 2010121345 | A1 | 10/2010 |
| WO | 2010121346 | A1 | 10/2010 |

OTHER PUBLICATIONS

Extreme Engineering XPulse specification sheet, Oct. 9, 2012.
Cathedral FUSION MWD Brochure, Jan. 14, 2012.
www.mostardirectional.com, Oct. 7, 2011.

* cited by examiner

| DESCRIPTIVE LEGEND |
| --- |
| 10-DRILL RIG |
| 10A-DERRICK |
| 10B-RIG FLOOR |
| 10C-DRAW WORKS |
| 12-DRILL STRING |
| 14-DRILL BIT |
| 15-ANNULAR REGION |
| 16-CASING |
| 17-BLOW OUT PREVENTER |
| 20-DOWNHOLE TRANSCEIVER |
| 24-PULSE TRANSDUCER |
| 26-SURFACE TRANSCEIVER |
| 28-EM WAVES |
| 28A-EQUIPOTENTIAL LINES |
| 28B-CURRENT FLOW |
| 30-GROUND RODS |
| 32-DISPLAY |

DOWNHOLE TELEMETRY

CROSS-REFERENCE TO RELATED APPLICATIONS

This application is a continuation of U.S. application Ser. No. 14/189901 filed 25 Feb. 2014, which claims the benefit under 35 U.S.C. § 119 of U.S. Application No. 61/768936 filed 25 Feb. 2013 and entitled DOWNHOLE TELEMETRY, both of which are hereby incorporated herein by reference for all purposes.

TECHNICAL FIELD

This application relates to subsurface drilling, specifically to telemetry between bottom hole assemblies and surface operators. Embodiments are applicable to drilling wells for recovering hydrocarbons.

BACKGROUND

Recovering hydrocarbons from subterranean zones typically involves drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid, usually in the form of a drilling "mud", is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at surface.

Bottom hole assembly (BHA) is the name given to the equipment at the terminal end of a drill string. In addition to a drill bit, a BHA may comprise elements such as: apparatus for steering the direction of the drilling (e.g. a steerable downhole mud motor or rotary steerable system); sensors for measuring properties of the surrounding geological formations (e.g. sensors for use in well logging); sensors for measuring downhole conditions as drilling progresses; one or more systems for telemetry of data to the surface; stabilizers; heavy weight drill collars; pulsers; and the like. The BHA is typically advanced into the wellbore by a string of metallic tubulars (drill pipe).

Modern drilling systems may include any of a wide range of mechanical/electronic systems in the BHA or at other downhole locations. Such electronics systems may be packaged as part of a downhole probe. A downhole probe may comprise any active mechanical, electronic, and/or electromechanical system that operates downhole. A probe may provide any of a wide range of functions including, without limitation: data acquisition; measuring properties of the surrounding geological formations (e.g. well logging); measuring downhole conditions as drilling progresses; controlling downhole equipment; monitoring status of downhole equipment; directional drilling applications; measuring while drilling (MWD) applications; logging while drilling (LWD) applications; measuring properties of downhole fluids; and the like. A probe may comprise one or more systems for: telemetry of data to the surface; collecting data by way of sensors (e.g. sensors for use in well logging) that may include one or more of vibration sensors, magnetometers, inclinometers, accelerometers, nuclear particle detectors, electromagnetic detectors, acoustic detectors, and others; acquiring images; measuring fluid flow; determining directions; emitting signals, particles or fields for detection by other devices; interfacing to other downhole equipment; sampling downhole fluids; etc. A downhole probe is typically suspended in a bore of a drill string near the drill bit.

A downhole probe may communicate a wide range of information to the surface by telemetry. Telemetry information can be invaluable for efficient drilling operations. For example, telemetry information may be used by a drill rig crew to make decisions about controlling and steering the drill bit to optimize the drilling speed and trajectory based on numerous factors, including legal boundaries, locations of existing wells, formation properties, hydrocarbon size and location, etc. A crew may make intentional deviations from the planned path as necessary based on information gathered from downhole sensors and transmitted to the surface by telemetry during the drilling process. The ability to obtain and transmit reliable data from downhole locations allows for relatively more economical and more efficient drilling operations.

There are several known telemetry techniques. These include transmitting information by generating vibrations in fluid in the bore hole (e.g. acoustic telemetry or mud pulse (MP) telemetry) and transmitting information by way of electromagnetic signals that propagate at least in part through the earth (EM telemetry). Other telemetry techniques use hardwired drill pipe, fibre optic cable, or drill collar acoustic telemetry to carry data to the surface.

Advantages of EM telemetry, relative to MP telemetry, include generally faster baud rates, increased reliability due to no moving downhole parts, high resistance to lost circulating material (LCM) use, and suitability for air/underbalanced drilling. An EM system can transmit data without a continuous fluid column; hence it is useful when there is no drilling fluid flowing. This is advantageous when a drill crew is adding a new section of drill pipe as the EM signal can transmit information (e.g. directional information) while the drill crew is adding the new pipe. Disadvantages of EM telemetry include lower depth capability, incompatibility with some formations (for example, high salt formations and formations of high resistivity contrast), and some market resistance due to acceptance of older established methods. Also, as the EM transmission is strongly attenuated over long distances through the earth formations, it requires a relatively large amount of power so that the signals are detected at surface. The electrical power available to generate EM signals may be provided by batteries or another power source that has limited capacity.

A typical arrangement for electromagnetic telemetry uses parts of the drill string as an antenna. The drill string may be divided into two conductive sections by including an insulating joint or connector (a "gap sub") in the drill string. The gap sub is typically placed at the top of a bottom hole assembly such that metallic drill pipe in the drill string above the BHA serves as one antenna element and metallic sections in the BHA serve as another antenna element. Electromagnetic telemetry signals can then be transmitted by applying electrical signals between the two antenna elements. The signals typically comprise very low frequency AC signals applied in a manner that codes information for transmission to the surface. (Higher frequency signals are typically attenuated more strongly than low frequency signals.) The electromagnetic signals may be detected at the surface, for example by measuring electrical potential differences between the drill string or a metal casing that extends into the ground and one or more ground rods.

Drill rig operators sometimes provide in a drill string multiple independently-operating telemetry systems, each coupled with sensor systems such that each telemetry system communicates to a surface receiver readings collected by the sensor systems with which it is coupled. This requires substantial duplication of parts and additional batteries in the BHA, resulting in increased length of the BHA, increased cost, and (insofar as the sensors are necessarily positioned further away from the drill bit in the elongated BHA) decreased accuracy of sensor readings.

There remains a need for systems and methods that provide the advantages of EM and MP telemetry while ameliorating at least some of the various disadvantages of providing multiple modes of telemetry in a BHA.

SUMMARY

The invention has a number of aspects. One aspect provides telemetry systems for downhole applications. Some such telemetry systems include a plurality of telemetry controllers each associated with a telemetry subsystem. The telemetry controllers may be configured to obtain and transmit parameter values.

Another aspect provides telemetry methods. Some such methods comprise switching among different telemetry configurations based on one or more of a range of factors as described herein. Some such methods comprise conditionally transmitting certain data (e.g. certain parameter values). Some such methods comprise detecting a status of drilling operations at a downhole tool and switching among telemetry configurations based on the detected status. Some such methods comprise transmitting at least some of the same data by way of two or more different telemetry subsystems. Some such methods automatically inhibit operation of one or more telemetry systems based on configuration setting. Other methods comprise combinations of two or more of the foregoing.

Another aspect comprises a downhole tool comprising a pressure-tight housing and two or more telemetry drivers for different telemetry modes (for example EM and MP) contained within the pressure-tight housing.

Another aspect provides a receiver for telemetry information configured to track and display information indicating the readings have changed since data values were most recently updated.

Another aspect provides a telemetry system comprising: a plurality of telemetry subsystems and a control system comprising a plurality of telemetry controllers. Each telemetry controller is associated and in communication with at least one telemetry subsystem of the plurality of telemetry subsystems. Each telemetry controller of the plurality of telemetry controllers is in communication with each other telemetry controller of the plurality of telemetry controllers via a bus. One or more sensors is in communication with the plurality of telemetry controllers. A first telemetry controller of the plurality of telemetry controllers is configured to obtain first sensor information from a first set of the one or more sensors and to transmit the first sensor information on a first telemetry subsystem of the plurality of telemetry subsystems. A second telemetry controller of the plurality of telemetry controllers is configured to obtain second sensor information from a second set of the one or more sensors and to transmit the second sensor information on a second telemetry subsystem of the plurality of telemetry subsystems. The telemetry controllers may be configured to independently control whether or not the associated telemetry subsystem is operative to transmit data and/or to independently control what data is transmitted by the associated telemetry subsystem.

In example embodiments the telemetry subsystems comprise an EM telemetry subsystem and a MP telemetry subsystem.

Another aspect provides a method of configuring a telemetry system. The method comprises receiving first information and in response to receiving the first information, configuring a first telemetry controller to transmit a first sensor information on a first telemetry subsystem. The method further comprises receiving second information, and in response to receiving the second information, reconfiguring the first telemetry controller to transmit a second sensor information on the first telemetry subsystem. The work mode may be controlled by downlink information.

Another aspect provides a method of operating a telemetry system. The method comprises receiving, at a first controller, first sensor information from a first set of sensors, transmitting by a first telemetry subsystem, the first sensor information, receiving, at a second controller, second sensor information from a second set of sensors, and transmitting by a second telemetry subsystem, the second sensor information.

Another aspect provides a telemetry system comprising: one or more sensors; a first telemetry subsystem in communication with the one or more sensors; a second telemetry subsystem in communication with the one or more sensors; and a control system configured to obtain first sensor information from a first set of the one or more sensors and to transmit the first sensor information on a first telemetry subsystem and to obtain second sensor information from a second set of the one or more sensors and to transmit the second sensor information on a second telemetry subsystem.

Another aspect provides apparatus comprising any new useful and inventive feature, combination of features or sub-combination of features described or clearly inferred herein.

Another aspect provides a method comprising any new, useful and inventive step, act, combination of steps and/or acts, or sub-combination of steps and/or acts described or clearly inferred herein.

Further aspects of the invention and features of example embodiments are illustrated in the accompanying drawings and/or described in the following description.

BRIEF DESCRIPTION OF THE DRAWINGS

The accompanying drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Figure 1:
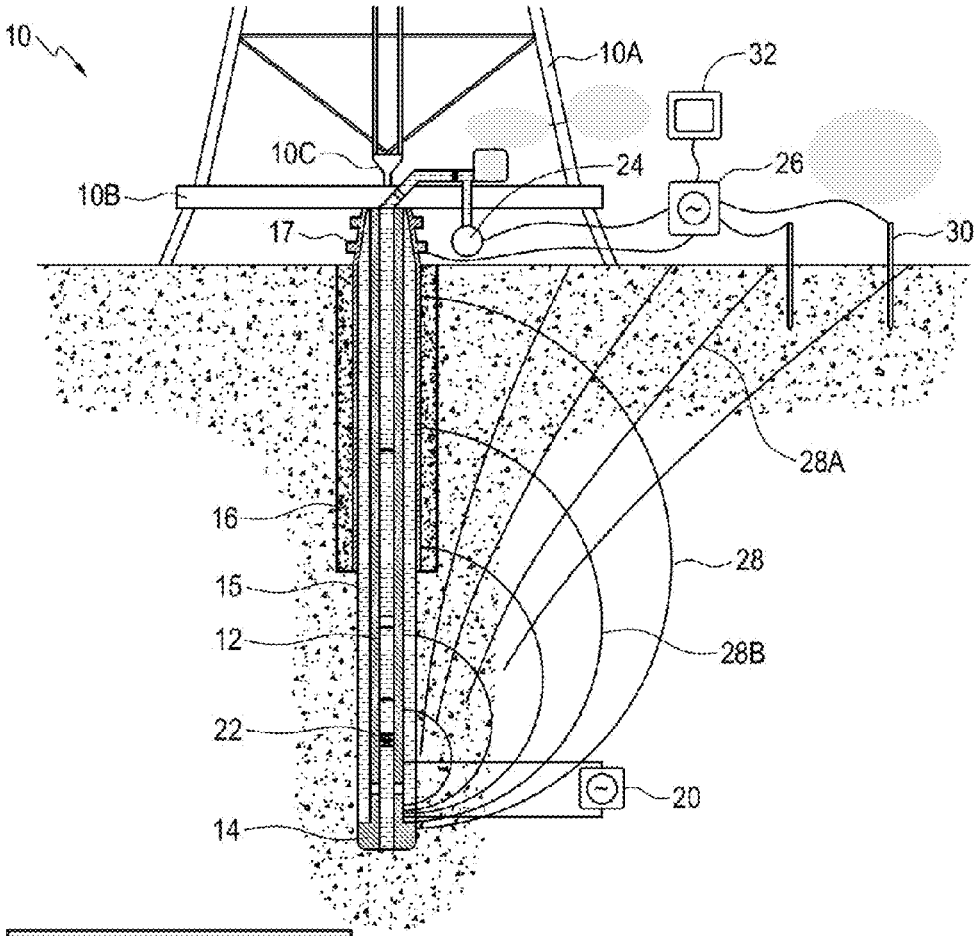
FIG. 1 is a schematic view of an example drilling operation.

FIG. 1 shows schematically an example drilling operation. A drill rig 10 drives a drill string 12 which includes sections of drill pipe that extend to a drill bit 14. The illustrated drill rig 10 includes a derrick 10A, a rig floor 10B and draw works 10C for supporting the drill string. Drill bit 14 is larger in diameter than the drill string above the drill bit. An annular region 15 surrounding the drill string is typically filled with drilling fluid. The drilling fluid is pumped through a bore in the drill string to the drill bit and returns to the surface through annular region 15 carrying cuttings from the drilling operation. As the well is drilled, a casing 16 may be made in the well bore. A blow out preventer 17 is supported at a top end of the casing. The drill rig illustrated in FIG. 1 is an example only. The methods and apparatus described herein are not specific to any particular type of drill rig.

Further, a system like that of FIG. 1 may include a system for communicating information between the surface and a downhole location. Thus it is possible to provide two-way communication between the surface and a downhole tool. The principles described herein may be applied to one-way data communication or two-way data communication or even to multi-way data communication between a plurality of downhole devices and the surface.

In the illustrated embodiment, downhole transceiver 20 is in data communication with a surface transceiver 26. Downhole transceiver 20 may uses two or more telemetry techniques to communicate data to surface transceiver 26. In some embodiments these telemetry techniques may be any two distinct telemetry techniques. For example, the telemetry techniques may be selected from: electromagnetic telemetry, mud pulse telemetry, drill string acoustic telemetry, acoustic telemetry, etc.

In an example embodiment that also has certain advantages the two telemetry techniques include electromagnetic telemetry and mud pulse telemetry. In mud pulse telemetry, data is communicated through the use of mud pulses 22, which are generated at a downhole location, received by a pulse transducer 24 and communicated to surface transceiver 26. Pulse transducer 24 may, for example, comprise a pressure sensor that detects variations in the pressure of the drilling fluid in drill string 12.

Electromagnetic telemetry comprises generating electromagnetic waves at a downhole location. The electromagnetic waves 28 propagate to the surface. FIG. 1 shows equipotential lines 28A and lines of current flow 28B. These lines are schematic in nature as the earth is typically non-uniform.

As described above, electromagnetic waves 28 may be detected by surface transceiver 26. In the illustrated embodiment, surface transceiver 26 is connected to measure potential differences between one or more ground rods 30 and the drill string. Surface transceiver 26 may be in communication with a display 32, by which received information may be displayed to one or more users.

Surface transceiver 26 may optionally be configured to transmit information to downhole transceiver 20 through any one or more of the telemetry techniques for which surface transceiver 26 is equipped to transmit. This facility may enable users of drill rig 10 to send, for example, control information to downhole transceiver 20 and, therefore, to the bottom hole assembly. Surface transceiver 26 may, in some embodiments, transmit data to downhole transceiver 20 using one or more telemetry techniques with which downhole transceiver 20 can only receive (and not transmit) data. For example, in a drill rig 10 in which the drill string is driven from the surface, data may be transmitted to downhole transceiver 20 by varying drilling parameters (such as speed of rotation). Surface transceiver 26 may also, or alternatively, transmit data to downhole transceiver 20 using one or more telemetry techniques with which downhole transceiver 20 can both receive and transmit data. For example, a downhole transceiver 20 with electromagnetic telemetry capabilities may be configured to both receive and transmit data using electromagnetic telemetry.

Figure 2:
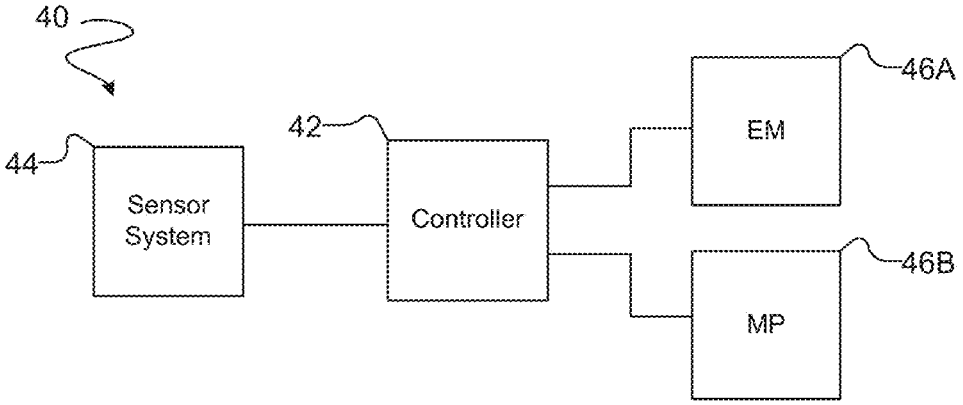
FIG. 2 is a logical diagram of an example telemetry system.

FIG. 2 shows logically an example telemetry system 40. A control system 42 is in communication with a sensor system 44 and one or more telemetry systems 46. In the depicted example, telemetry systems 46 comprise an EM telemetry system 46A and an MP telemetry system 46B. Control system 42 receives sensor data from sensor system 44 and provides it to one or more of the telemetry systems 46 for transmission. Sensor system 44 may comprise a plurality of sensors, including shock sensors, RPM sensors, flow switch sensors, direction and inclination sensors, gamma logging sensors, pressure sensors, and any other sensors known in the art or later discovered.

Figure 2A:
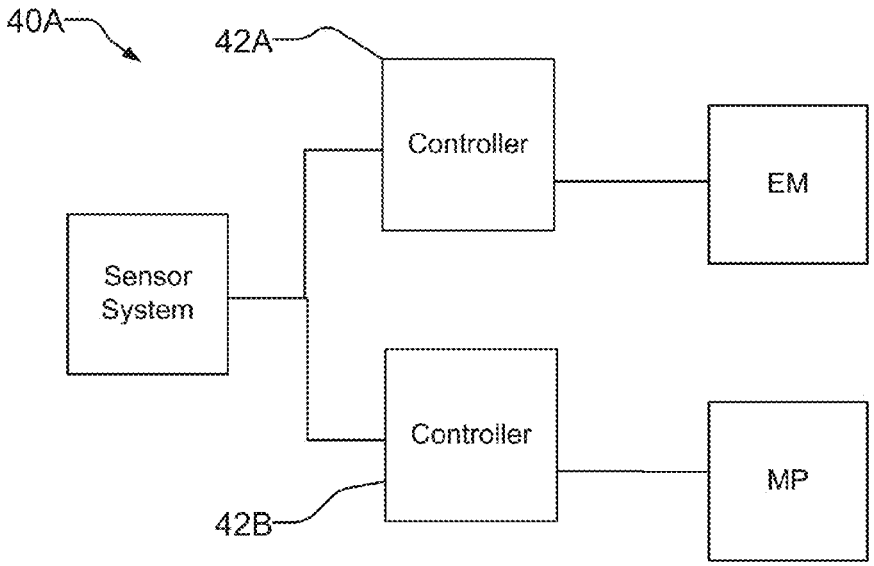
FIG. 2A is a logical diagram of another example telemetry system.

FIG. 2A shows another example telemetry system 40A which differs from telemetry system 40 in that a dedicated controller is provided for each telemetry system. FIG. 2A shows a controller 42A for MP telemetry and a controller 42B for EM telemetry.

Control system 42 may comprise one physical device, such as a CPU, or a plurality of devices working independently or collectively to receive and/or transmit data using telemetry systems 46. In some embodiments, such as the example embodiment depicted in FIG. 3 (described below), each telemetry system 46 is associated with a corresponding controller. An additional number of controllers may be provided, each in association with one or more sensors of sensor system 44. All of these controllers may collectively make up control system 42.

Figure 3:
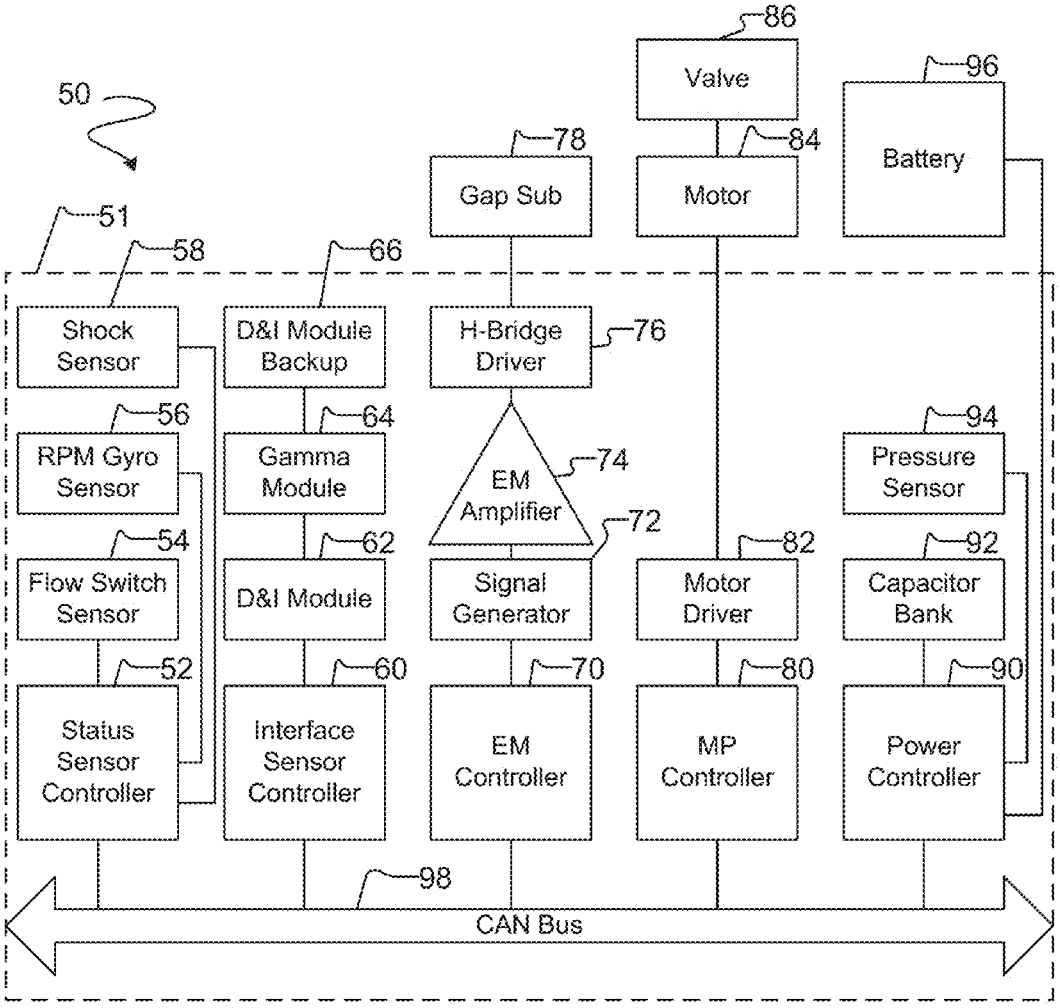
FIG. 3 is a schematic view of an example embodiment of a telemetry system according to FIG. 2.

FIG. 3 shows schematically a telemetry system 50 according to an example embodiment. Example telemetry apparatus 50 is at least partially contained in housing 51. The elements contained in housing 51 may be implemented on one or more circuit boards, connected by suitable electrical and logical wiring, and/or interconnected in any other manner known in the art.

Example telemetry apparatus 50 comprises a plurality of controllers which together make up a control system 42. The illustrated embodiment includes status sensor controller 52, interface sensor controller 60, EM controller 70, MP controller 80, and power controller 90.

Status sensor controller 52 is connected to sensors which monitor parameters relevant to the current status of the bottom hole assembly. In some embodiments, outputs of one or more such sensors is used to control switching one or more systems of apparatus 50 on or off or to otherwise control the operation of such systems. In the depicted embodiment, such sensors include flow switch sensor 54, which detects the status of the drilling fluid flow switch in the BHA, RPM gyro sensor 56, which detects rotation speed of the BHA and gyroscopic information, and shock sensor 58, which may detect shock forces encountered by the BHA in three-dimensions.

Interface sensor controller 60 is generally in communication with sensors that monitor parameters that are indicative of characteristics of the surrounding formation and/or the bottom hole assembly's position relative to the formation. In this embodiment, such sensors include direction and inclination systems 62, gamma system 64, which measures the composition of the surrounding formation through the measurement of gamma emission and direction and back-up inclination system 66. Additional sensors of any suitable types may be provided.

EM controller 70 is in communication with an EM telemetry sub-system comprising a signal generator 72, which may be implemented with a digital to analog converter, an EM amplifier 74, which amplifies the signal output by signal generator 72 to a level that is capable of being received by surface transducer 26, and H-bridge driver 76, which applies an alternating voltage across gap sub 78 on the exterior of housing 51. EM controller 70 may communicate any information accessible to it to users of a drill rig 10 by providing digital signals encoding such information to signal generator 72. For example, EM controller 70 may communicate information measured by one or more sensors and provided to EM controller 70 by the associated sensor controller, such as status sensor controller 52 or interface sensor controller 60.

MP controller 80 controls the mud pulse telemetry subsystem by providing signals to a motor driver 82 which then operates motor 84. Motor 84 may then open and/or close valve 86 so as to increase or decrease pressure in the drill string 12 or otherwise induce acoustic pulses or oscillations in the drilling fluid. MP controller 80 may receive information from the surface by detecting the flow of drilling fluid in drill string 12. For example, a drilling operator may control the flow of drilling fluid in a pattern that conveys information to apparatus 50. This may be implemented, in some embodiments, by communicating the sensor readings of flow switch sensor 54 through status sensor controller 52 to MP controller 80. Alternatively, or in addition, MP controller 80 may be configured to have direct or indirect access to a flow switch sensor 54, pressure sensor 94, or other sensor(s) configured to detect messages received from surface transceiver 26 or actions of a drilling operator without the use of intervening status sensor controller 52.

Power controller 90 is in electrical communication with one or more power sources such as one or more batteries 96 and generally manages the provision of electrical power to all or some of telemetry apparatus 50. In some embodiments, power controller 90 may selectively provide power to any one or more of the controllers and/or their associated sub-systems and/or reduce or cut off power to certain of the controllers and/or sub systems when possible to save power. Power controller 90 may be provided with a capacitor bank 92 for the short- or long-term storage of energy.

In some embodiments, power controller 90 comprises or is connected to receive an output from a pressure sensor 94. Pressure sensor 94 senses pressure within the drill string. This pressure typically varies with depth in the wellbore. Power controller 90 may be configured to control power to certain sub-systems or controllers based on the output of pressure sensor 94. For example, power controller 90 may be configured to inhibit operation of the EM telemetry sub-system (e.g. by cutting off power to all or part of the EM telemetry sub-system) when housing 51 is at or near the surface (for example, by detecting an output from pressure sensor 94 indicating low pressure). This feature may improve safety by avoiding charging the exterior of housing 51 to high voltages while housing 51 is at or near the surface.

Power controller 90 may optionally provide readings of pressure sensor 94 to other controllers either in response to requests from the other controllers or otherwise. In some embodiments, power controller 90 or one or more other controllers may be configured to switch system 50 among a number of different operational modes in response to changes in the readings from pressure sensor 94. For example, the different operational modes may transmit different data to the surface and/or transmit that data using different arrangements of one or more telemetry sub-systems. For example, for some depths system 50 may use EM telemetry, for other depths system 50 may use MP telemetry, at other depths, system 50 may use both EM and MP telemetry concurrently.

The various controllers of control system 42 may be in communication via a data communications bus, such as a CAN (controller area network) bus 98. In other embodiments, the controllers may be in communication via any other suitable protocol, on physical or wireless networks, or in any other manner now known or later developed.

Control system 42 may be in communication with other sensors, systems, components, devices or the like via CAN bus 98 or otherwise. For example, control system 42 may also, or alternatively, be in communication with a near-bit tool, which may provide to control system 42 measurements taken near to drill bit 14. Such measurements may be transmitted by telemetry system 40 in any of the ways disclosed herein.

In one embodiment, housing 51 comprises a single pressure-tight housing. It is advantageous to provide a compact telemetry apparatus that comprises drivers for two or more telemetry methods within a single pressure-tight housing. Some embodiments feature a probe housing that is both shorter and wider than the industry standards; in a preferred embodiment, the probe housing is substantially shorter than current industry-standard telemetry probes, measuring less than 6 feet, and preferably no more than 4 feet in length.

Housing 51 may, in some embodiments, comprise a cylindrical tube made up of two metallic parts with an electrically-insulating break between them. EM signals from a generator inside housing 51 may be connected to the metallic parts of the housing which may, in turn, be in electrical contact with the two sides of a gap sub. In some embodiments, housing 51 is positioned such that portions of housing 51 extend to either side of gap sub 78. It can be beneficial to configure apparatus 50 such that the electrically-insulating break is located away from sensitive electronics of apparatus 50. For example, the electrically-insulating break may be located near one end of housing 51. The electrically-insulating break can be anywhere along housing 51 in other embodiments. All that is required is a structure that permits two outputs of a signal generator to be connected to opposing sides of a gap sub.

In some embodiments the generator for EM signals comprises a power supply having first and second outputs and an H-bridge circuit connected to the outputs such that the power supply outputs can be connected to opposing sides of gap sub 78 (for example, by way of opposing parts of housing 51) in either polarity. For example, in a first configuration of the H bridge, one power supply output is electrically connected to an uphole side of gap sub 78 and the other power supply output is connected to the downhole side of gap sub 78. In a second H-bridge configuration the power supply outputs are reversed such that the first power supply output is electrically connected to the downhole side of gap sub 78 and the second power supply output is electrically connected to the uphole side of gap sub 78. The first and second power supply outputs are at different potentials (e.g. ground and a set voltage relative to ground).

An alternating signal of a desired frequency may be applied across gap sub 78 by switching the H bridge between the first and second configurations described above at twice the desired frequency. An H-bridge driver 76 that includes the H bridge circuit may be located at or near the electrically-insulating break in housing 51. This facilitates a relatively direct connection of H-bridge driver 76 to the sides of gap sub 78.

In some embodiments, control circuitry (such as control system 42 and CAN bus 98) and other devices (such as capacitor bank 92) are integrated onto one or more short (e.g. 12-inch-long) carrier boards, together constituting a control system inside of housing 51. In some embodiments, the components of telemetry apparatus 50 are arranged in the following sequence: valve 86, motor 84, control system, gamma system 64, direction and inclination system 62, and battery 96. Such embodiments may be used in either orientation (i.e. valve 86 positioned on either the uphole or downhole end), but positioning valve 86 on the downhole end of the probe may reduce damage from the flow of drilling fluid on the seals of the probe.

It can be appreciated that at least some embodiments provide a single set of sensors and a system for managing data from the sensors while providing the flexibility to transmit any of the data by way of a plurality of different telemetry links. In some embodiments data (whether the same data or different data) may be transmitted concurrently on two or more telemetry links. In some embodiments the system has a configuration which permits each of two or more telemetry systems (which may operate using different physical principles) to operate independently of one another. A power management system may control the supply of power to the telemetry links from a common power source or set of power sources thereby facilitating better power management than would be possible if each telemetry link was powered from a separate source.

Telemetry system 40 enables the sharing of resources and sensor data by telemetry systems 46 and the joint or independent control of telemetry systems 46 by control system 42. The flexibility of telemetry system 40 facilitates configuring telemetry system 40 to promote benefits such as: faster data communication, better energy efficiency, more reliable data communication; and more flexible data communication.

Apparatus as described herein may include a data control system that controls what data is carried by which telemetry system. The data control system may also control when that data is transmitted (e.g. certain data may be transmitted more frequently than other data, certain data may be transmitted in real time or near-real-time and other data may be stored and transmitted later). Where two or more telemetry systems are provided, the data control system may be operable to selectively: transmit certain data on one telemetry system and no data on another telemetry system; transmit certain data on one telemetry system and other data on the other telemetry system; transmit certain data on more than one telemetry system; change the selection of data to be transmitted and/or the allocation of that data among the telemetry systems and/or how often certain data is transmitted. Where the same data is transmitted on different telemetry systems it is optionally possible to transmit updates data more frequently in one telemetry system than another.

The ability to allocate data between different telemetry systems can be used to advantage in a wide range of ways. For example, survey data may be sent by EM telemetry while active drilling is not in progress. This relieves the need to transmit survey data by MP telemetry and permits MP telemetry to be used to send active data as soon as the flow of drilling fluid is sufficient to support mud pulse telemetry. In an example method, a controller in telemetry system 40 monitors a sensor output to determine whether active drilling is occurring. For example, the controller may monitor the output of a flow sensor. If active drilling is not occurring (no flow or low flow detected) then the controller may cause data, for example survey data, to be transmitted by EM telemetry. If active drilling is occurring (flow exceeds a threshold) then the controller may cause the data to be transmitted by MP telemetry.

As another example, data that might otherwise be transmitted by EM telemetry could be transmitted by MP telemetry instead in cases where rotating noise makes EM reception unduly difficult or unreliable or where horizontal drilling is being performed and overlying formations may impair the effectiveness of EM telemetry. In an example method, data is sent simultaneously by MP telemetry and EM telemetry. The EM telemetry data may be different from the MP telemetry data. A controller of telemetry system 40 determines that EM telemetry is ineffective or undesired. The controller may make this determination, for example, based on one or more of: a current of an EM signal generator (too high current indicates conductive formations in which EM telemetry may be ineffective); a downlink signal from the surface using any available telemetry mode or predefined pattern of manipulation of drill string rotation and/or mud flow; an inclinometer reading (the system may be configured to not use EM telemetry once the inclination of the BHA is closer to horizontal than a threshold angle; and a measure of rotating noise. Upon determining that EM telemetry is ineffective or undesired the controller may automatically shut of the EM telemetry system and reallocate data being transmitted to the MP telemetry system such that a desired set of data is transmitted by MP telemetry.

As another example, the 'duty cycles' of the different available telemetry systems may be varied. Each telemetry system may be active at some times and off at other times. For example, where there is a need to transmit certain data that exceeds the available bandwidth of a preferred telemetry system, another telemetry system may be made active only for selected periods which are sufficient to carry the balance of the data to be transmitted. As another example, each telemetry system may be configured to actively transmit data in certain time slots and to be off in other time slots. This may be done independently for each telemetry system. The pattern of when a telemetry system will be on or off may be specified in a configuration profile. In another embodiment a telemetry system may operate on demand. When that telemetry system has data to transmit then the telemetry system may be made active for long enough to transmit the data. Otherwise the telemetry system may be kept in a non-transmitting state.

The data control system may comprise a switchboard that matches available data to available slots in a data transmission protocol or protocols. For example, in some embodiments, a telemetry system transmits data in frames which can each carry a certain amount of data. In such embodiments the data control system may match data to be transmitted to slots in data frames to be transmitted. With an architecture in which all sensor systems are interconnected by a data transmission bus (FIG. 3 is but one example of such an architecture) the data control system can transmit any selected data on any available telemetry system.

Various data transmission protocols may be used so that surface equipment will understand the significance of the transmitted data. For example, the data control system may transmit control information indicating what data will be, is being or has been transmitted in available slots of a data transmission protocol. As another example, the data control system may assign data to slots in a data transmission protocol according to instructions provided from the surface. As another example, the data control system may be configured to assign data to slots in a data transmission protocol according to one or more predetermined arrangements. As another example, the data may be distinguishable (e.g. outputs from certain different sensors may typically have values in ranges different from the outputs of other sensors) such that the assignment of data to slots in a data transmission protocol may be inferred from analysis of data received at the surface. As another example, the data control system may assign data to slots in a data transmission protocol according to predetermined rules such that surface equipment can infer from the predetermined rules what data the data control system has is assigned to different slots in a data transmission protocol. As another example, the data control system may be configured to use different data transmission protocols for different arrangements of transmitted data such that surface equipment may infer the arrangement of transmitted data by determining what transmission protocol the data control system is using. Other possibilities also exist. These methods may also be combined in any combinations to yield further methods. In some embodiments information regarding the arrangement of data being transmitted using one telemetry system is transmitted by another telemetry system.

A protocol may specify other aspects of transmitted signals such as a coding type to be used (8PSK, QPSK, FSK, etc.) and bit rate.

In one example embodiment data is transmitted according to a protocol which specifies syntax for a frame. Each frame may comprise a header section that establishes the timing, amplitude and type of message frame. For example, the header may comprise two parts that are transmitted as one continuous stream. The first part may comprise a specified fixed waveform that has a pattern selected such that the pattern can be easily distinguished from noise. Transmission of this pattern may serve to synchronize the receiver to the timing and amplitude of the waveform. The second part of the header comprises a variable waveform that functions to identify a type (ID) of the frame.

Different frame types may be called for depending on the functions being carried out by the drill rig. For example, survey frames which include data that is typically high priority (e.g. inclination, azimuth, sensor qualification/verification data, plus other information as desired) may be sent in preparation for drilling. For example, survey frames may be sent by EM telemetry during a drill pipe connection or by MP telemetry as soon as sufficient mud is flowing. Sliding frames may be sent during drilling when the drill string is not being rotated from the surface. Sliding frames may, for example be configured to send a steady stream of toolface readings and may also include additional data sent between successive toolface messages. Rotating frames may be sent while the drill string is rotating at the surface. Rotating frames typically do not include toolface data as such data is not generally relevant while the drill string is being rotated from the surface. Any other data is included in rotating frames as desired.

A downhole tool may be configured to switch automatically between transmitting different types of frames. For example, the downhole tool may comprise a flow sensor (which may monitor flow by detecting vibration of the tool). The tool may control when survey data is acquired and when the tool sends survey frames based on an output of the flow sensor. The tool may configure itself to send survey frames when the flow sensor detects no flow and may configure itself to send active frames (e.g. sliding frames or rotating frames) when the flow sensor detects flow in excess of a threshold flow. The tool may comprise an accelerometer or other rotation sensor and may automatically switch between transmitting sliding frames and rotating frames based on a detected rotation rate (with rotating frames being transmitted when the rotation rate exceeds a threshold).

Other frame types may be generated in other contexts. For example, status change frames may be generated used to alert the receiver of changes in the telemetry type, speed, amplitude, configuration change, significant sensor change (such as a broken main accelerometer, for example), or other change to the status of the downhole tool. The sending of status frames may be triggered by particular events. For example, a downlink command received from the surface, or a sensor failure in the tool occurs.

A data control system may be distributed. For example, a separate data control system may be provided for each telemetry system. These data control systems may operate independently of one another. Each of the data control systems may be configured to transmit certain items. The configurations of different data control systems may be complementary so that each necessary item of data is transmitted over one or more of the telemetry systems. In such embodiments it is not mandatory for the data control systems to interact with one another in normal operation.

In other embodiments the data control system is centralized and allocates data to available transmission slots for two or more telemetry systems. In still other embodiments each telemetry system includes a quasi-independent data control system but one of the data control systems acts to coordinate operation of other data control systems. In other embodiments, the data control system includes a central part that coordinates operation of subsystems associated with the different telemetry systems.

The data transmission protocol may comprise frames of data sent by one or more telemetry systems. Such frames may, for example, comprise a header portion and a data portion. The header portion may include an identifier that enables a recipient of the frame to read the data portion. For example, the data control system may be configured to transmit one type of frame (called "sliding" frames) while drill rig 10 is not rotating the string 12 from the surface. Sliding frames may be defined by the data control system to consist of alternating toolface readings and gamma readings in the data portion of each frame. The header portion of a sliding frame may include a unique identifier, not shared by other types of frames transmitted by the data control system, so that a recipient who receives the header portion of a sliding frame will know that the data portion that follows will conform to a known structure associated with that identifier.

The particular structure of the data portion of any type of frame may vary by embodiment or configuration of the data control system. Types of frames that a data control system may transmit include "survey" frames, which fill the data portion of the frame with survey information, which may include for example inclination, azimuth, sensor verification data, and other information as defined by the data control system. The data control system may also transmit "rotating" frames, which are transmitted while drill rig 10 is rotating drill string 12 from the surface. Rotating frames may encode information relevant to that circumstance (for example, it may not be necessary to provide toolface readings while the string is rotating). The data control system may also, or alternatively, transmit "status" frames in response to a change or event, such as a change in the type(s) of telemetry being used, a significant change in sensor readings, a change in telemetry speed, or the like.

A data control system may be implemented by one or more suitably programmed data processors, by specialized hardware, by configurable hardware (e.g. one or more field-programmable gate arrays (FPGAs)) or by a suitable combination thereof.

Figure 4:
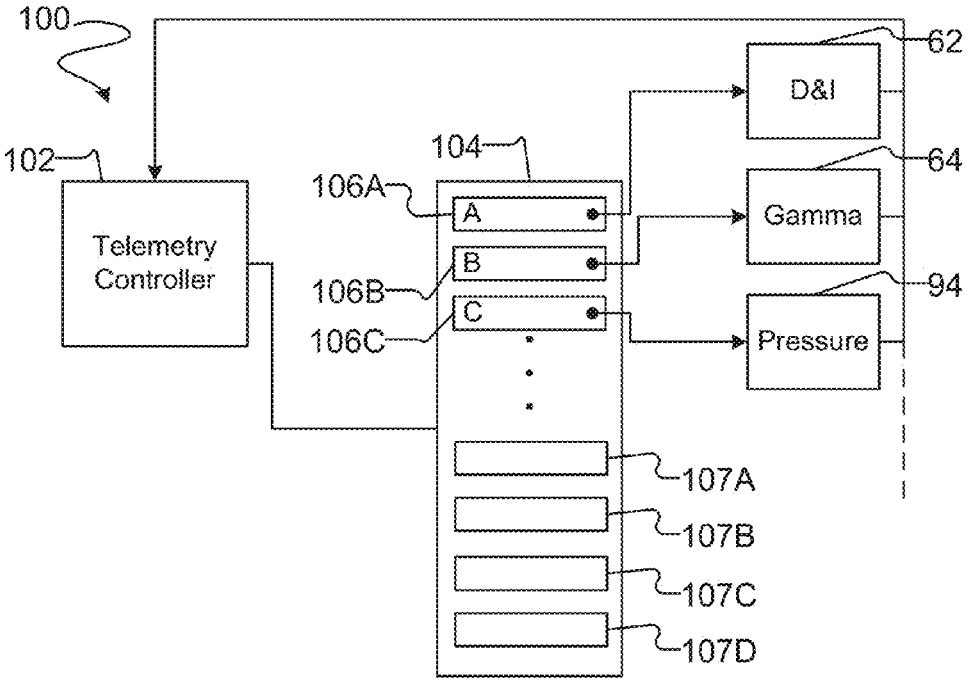
FIG. 4 is a schematic view of a telemetry configuration system.

FIG. 4 shows schematically an example telemetry configuration system 100 that includes a telemetry controller 102. Telemetry controller 102 may be, for example implemented by software code executing on EM controller 70 or MP controller 80. Telemetry controller 102 may more generally be any controller of control system 42 that is connected to a data bus that permits it to access data that could be transmitted and telemetry systems available to transmit the data.

Telemetry controller 102 has access to data storage 104. Data storage 104 may be a memory accessible by telemetry controller 102, a set of registers housed within telemetry controller 102 (if telemetry controller 102 comprises a CPU or other register-containing device), or any other suitably-configured device, system or service capable for storing information accessible to a telemetry controller 102.

Data storage 104 includes one or more data locations 106. For example, data storage 104 includes data locations 106A, 106B and 106C. Each data location 106 may store or identify (e.g. by way of an address or pointer) an item of data that may be transmitted by a telemetry system. In the example shown in FIG. 4, data location 106A corresponds to data from direction and inclination system 62, data location 106B corresponds to data from gamma system 64, and data location 106C corresponds to data from pressure sensor 94. Data locations 106 collectively provide data that is available to be included in data to be transmitted to surface transceiver 26 by a telemetry system.

Data storage 104 includes one or more data locations 107. For example, data storage 104 includes data locations 107A, 107B and 107C. Each data location 107 may correspond to an available slot in which an item of data may be transmitted by a telemetry system. Each data location 107 may include a value that identifies one of data locations 106. Thus, the sequence of items of data to be transmitted by a telemetry system may be controlled by writing values to data locations 106 which identify data to be transmitted and values to data locations 107 which identify the sequence in which that data will be transmitted by a telemetry system. In some embodiments, different sets of data locations 107 may be provided for different telemetry systems.

Those of skill in the art will understand that a similar result may be achieved using a single set of data locations for each telemetry system in which the single set of data locations each corresponds to an available transmission slot and each can contain or identify an item of data to be transmitted.

Telemetry controller 102 maps data locations 106 to the contents of data frames for transmission. For example, telemetry controller 102 may be configured to transmit the data identified by data location 106A and 106B in one frame, and to transmit data identified by data locations 106C, 106D and 106E (data locations 106D and 106E not depicted) in the next frame. On subsequent frames, telemetry controller 102 may advance to yet further data locations 106F and so on or, if no further data locations are available, may loop back to data locations 106A and 106B. As another example, telemetry controller 102 may be configured to transmit the data identified by one or more data locations 106 (such as 106A) in each frame, and to vary which of the data associated with the remaining data locations 106 are included in each of the subsequent frames.

For example, if a telemetry controller 102 is configured such that each frame includes the data identified by the next three data locations 106 in sequence, every third data location 106 might be encoded with data originating from a highly important sensor, such as direction and inclination system 62, thereby ensuring that direction and inclination information is transmitted in every frame, while still leaving room for additional sensor information to be cycled through in subsequent frames. A similar result may be achieved by encoding only one data location 106 (suppose data location 106A) in a given data storage 104 with data identifying direction and inclination system 62 and configuring telemetry controller 102 to include the data identified by data location 106A in every frame.

Although it is possible for telemetry systems 46 to operate independently, or for telemetry system 40 to transmit data using fewer than all available telemetry systems 46 (e.g. in "EM-only" or "MP-only" modes), in at least some embodiments telemetry systems 46 may operate cooperatively to transmit data according to the configuration of control system 42. Any one or more of the one or more controllers in control system 42 may be configured to transmit information on one or more telemetry systems 46. Which data is transmitted via which telemetry systems 46 may be determined in response to the current configuration of control system 42 and, in some embodiments, a telemetry configuration system such as example telemetry configuration system 100.

The configuration may be set by a user prior to deployment of the bottom hole assembly, or (in some embodiments) may be set during the operation of the bottom hole assembly in response to: a control signals sent by surface transceiver 26 and received by telemetry system 40, one or more measurements collected by sensor system 44, or by the activation or deactivation of one or more sub-systems of telemetry system 40 (for example, EM telemetry system 46A or MP telemetry system 46B). Deactivation of a sub-system of telemetry system 40 may be due to, for example, damage, malfunction, an automated process, user instruction, intentional or unintentional power loss, conditions that impair the effectiveness of the telemetry system and/or any other reason.

Such configuration information may be stored in configuration profiles. For example, a first configuration profile may specify that while EM telemetry 46A and MP telemetry 46B are both active and available for transmission, EM telemetry 46A will transmit the most recent measurements from direction and inclination system 62, together with measurements from one or more of the remaining sensors. The first configuration profile may also provide that MP telemetry 46B will be dedicated solely to the transmission of the most recent measurements from gamma system 64. Such a configuration profile, where telemetry systems 46 transmit data independently so as to obtain a corresponding increase in the total bandwidth of telemetry system 40, may be referred to as a "concurrent shared" configuration profile. In such a configuration profile certain data may optionally be transmitted by each of two or more telemetry systems.

In some embodiment, each telemetry system transmits data in groups or 'frames' according to a data transmission protocol being used. In such embodiments configuration information may assign different data to different frames. For example, one telemetry system may transmit the most recent measurements from direction and inclination system 62 in some frames and may transmit measurements from one or more of the remaining sensors in other frames. The frames may alternate such that frames carrying one selection of data are interleaved with frames carrying other selections of data.

Further, in this example, control system 42 may be configured such that, if MP telemetry 46B is deactivated or if an appropriate instruction is received from the surface, then control system 42 may switch to an "EM-only" configuration profile. Such a configuration profile may, for example, configure the telemetry system to cause EM telemetry 46A to transmit the most recent measurement from gamma system 64 on every other frame (e.g. on odd numbered frames), leaving the remaining (e.g. even numbered frames) to be used for other desired data. Such a configuration profile may, alternatively, cause telemetry systems 46 to operate independently such that, in the event that one telemetry system 46 is deactivated, the remaining telemetry system(s) 46 continue to operate without changing their behaviour. A change in behaviour may still be caused by, for example, transmission of an instruction to change configuration profiles from the surface to the bottom hole assembly.

As will be evident to a person skilled in the art, many configurations are possible. For example, telemetry system 40 may provide a "concurrent confirmation" configuration profile. Such a profile may cause EM telemetry 46A and MP telemetry 46B to transmit the same data roughly concurrently. The recipient of these two signals (e.g. an operator on the surface) can then decode them and compare the data transmitted by each of the telemetry systems 46. If the data matches, the recipient may take that as an indication that telemetry systems 46 are operating correctly. If the data do not match, then the recipient may attempt to correct its decoding methods or apparatus or may conclude that one or more of telemetry systems 46 is not operating correctly. In this way, a concurrent confirmation configuration profile may serve as a "system test" mode, or may offer additional redundancy when critical data is being transmitted.

Control system 42 may, in response to certain sensor readings disable or suspend operation of one or more telemetry systems. For example the system may include a sensor connected to measure current of an EM signal. If the current exceeds a threshold then the EM system may be shut down or placed in a non-transmitting mode. In this event the system may automatically switch over to a "MP-only" configuration profile. The MP only profile may both specify that the EM system should be shut off or inhibited and specify data to be transmitted by MP telemetry in a specific sequence.

Other sensor readings that may prompt a change in configuration profile may, for example, include failing to detect MP pressure pulses at a pressure sensor or receiving pressure sensor readings that indicate that a valve used for generating MP pulses is jamming or otherwise malfunctioning. Control system 42 may be configured to switch over to an "EM only" configuration profile in response to detecting such sensor readings. The EM only profile may both specify that the MP system should be shut off or inhibited and specify specific data to be transmitted by EM telemetry in a specific sequence.

In some embodiments a system may be configured to use MP telemetry only and to switch to EM telemetry in the event that the MP system is not able to function properly (either because of a malfunction or due to downhole conditions being unsuitable for MP telemetry).

In some embodiments, control system 42 may automatically change profiles in response to such a sensor reading. In some embodiments, such a sensor reading may result in the transmission of one or more "status" frames to the surface indicating the sensor reading; this enables a surface operator to respond with an instruction to change configuration profiles.

In some embodiments, a user of drill rig 10 may cause surface transceiver 26 to transmit one or more control signals to downhole transceiver 20, and in particular to a telemetry system 46 of downhole transceiver 20, instructing telemetry system 40 to select, add, remove, and/or alter a configuration profile, thereby causing the behaviour of telemetry system 40 to change in response of receipt of such a control signal.

Figure 4A:
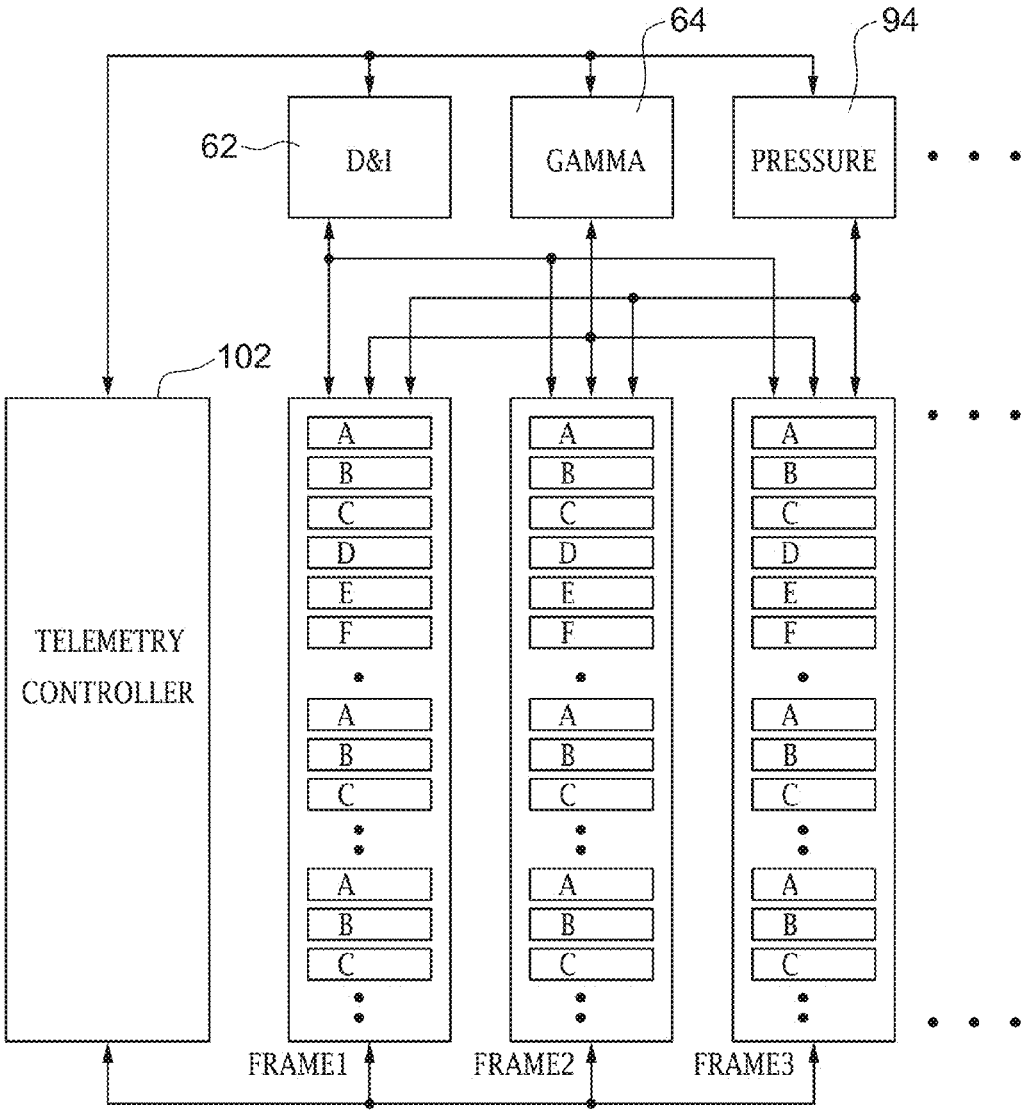
FIG. 4A is a schematic view of an alternative telemetry configuration system.

In some embodiments, configuration profiles stored in one or more downhole memories specify data content for a plurality of different predetermined frames. Each frame may specify a different set of data to send to the surface. An example of such an embodiment is illustrated by FIG. 4A. Telemetry controller 102 is configured to decide which frame(s) to send to the surface. This decision may be based upon downhole conditions picked up by sensors and/or downlink commands from the surface.

Different frames may specify different combinations of information (parameters) to be transmitted to the surface. For example, Frame '1' may include only data from a direction and inclination (D&I) system. Frame '2' may include a combination of data from the D&I system and data from a gamma system. Frame '3' may include a combination of data from the D&I system, data from one or more pressure sensors and other sensors' data etc. Any suitable number of predefined frames may be provided.

In some embodiments, telemetry controller 102 or, more generally, control system 42 may be configured to monitor certain parameters and to determine whether to transmit values for the monitored parameters to the surface by telemetry based on changes in the parameter values. Changes may be measured over a time frame (e.g. how much has the parameter value changed in the past 10 seconds or the past minute or the past 10 minutes or the past hour) and/or in relation to the most-recently transmitted value for the same parameter.

For example, in one example embodiment control system 42 records values of a number of parameters as previously transmitted to the surface by telemetry. Control system 42 then compares a current value of a parameter to the previously-transmitted value for the parameter. If this comparison indicates that the value for the parameter has changed by more than a threshold amount then the controller may be configured to transmit the current value for the parameter to the surface. The comparisons may be made in any suitable ways (e.g. subtracting one of the current and previously-transmitted parameter values from the other, determining a ratio of the current and previously-transmitted parameter values etc). Different change thresholds may be provided for different parameters.

In addition or in the alternative control system 42 may record values of the parameters at intervals (which may optionally be different for different parameters) and may compare a currently-recorded value for a parameter to a previous value (or an average or weighted average of a number of previous values) and determine whether the change exceeds a threshold. Again, different thresholds may be provided for different parameters.

Comparisons as described above may be made periodically, and/or each time a new value for a parameter is obtained and/or each time there is an opportunity for transmission of such parameter values.

In some embodiments control system 42 may prioritize transmission of current parameter values which are different enough from previous values (for example according to differences as determined above) to require retransmission. Parameter values that are not different enough from previous values do not need to be transmitted. One advantage of transmitting certain parameter values only if the values have changed is that the amount of power required for data transmission may be reduced and battery life may therefore be extended. Another advantage that may be achieved in some embodiments is freeing bandwidth to transmit other data.

Prioritizing of such transmissions may be based upon one or both of a predetermined priority order and an amount of change of the parameter. In an example embodiment, control system 42 maintains an ordered list of the monitored parameters. Control system 42 determines as above whether it is desirable to transmit a current value for any of the parameters. When an opportunity arrives to transmit values for one or more of the parameters controller 42 may proceed down the ordered list and transmit the highest-priority ones of the parameters for which control system 42 has determined that the current value of the parameter should be transmitted. Where the opportunity exists to transmit N current parameter values where N is some integer then control system 42 may send the N highest-priority ones of the parameters for which control system 42 has determined that the current value of the parameter should be transmitted. Control system 42 may additionally transmit in a header or otherwise information identifying the specific parameter values being transmitted.

As a specific example, a control system 42 may be configured to transmit data in sets (e.g. frames) on one or more telemetry systems. Some frames may be reserved for specific data. For example, the first frame and every third frame after that may carry a first type of information (e.g. direction and inclination information). The second frame and every third frame after that may carry a second type of information (e.g. gamma information). The third frame and every third frame after that may be configured to carry variable information (i.e. one or more current values for parameters which have been selected for transmission based on a change in their values).

As another example, a control system 42 may be configured to send data in frames in which a portion of some or all frames is allocated to carry current values for selected parameters that have changed enough to require retransmission (if any).

As another example, control system 42 may be configured to send data for a plurality of parameters in a sequence. Control system 42 may check to determine whether it is unnecessary to transmit some or all of the parameters (e.g. it may be unnecessary to transmit a current parameter value if the current parameter value is close to the previously-transmitted parameter value). Where controller 42 determines that transmitting current values for one or more other parameters is unnecessary then controller 42 may be configured to perform one or more of: leaving a gap where the parameter value would have been transmitted; transmitting one or more special symbols in the slot where the parameter value would have been transmitted (the symbols may be selected for low power consumption); or compressing the remaining data together (and, if necessary or desired, transmitting information identifying the data transmitted or not transmitted).

In some embodiments control system 42 monitors two or more different sets of parameters (the sets of parameters could optionally have some or all members in common). Each telemetry system of a plurality of telemetry systems may be associated with one of the sets of parameters and configured to transmit current values for parameters from the corresponding set of parameters that have changed enough to require retransmission (if any). In some embodiments each telemetry system comprises a separate controller and the controller is configured to monitor parameters in the corresponding set and to transmit current values of the parameters where a condition relating to a change in the parameter value is satisfied. For example, an EM telemetry system may include a controller configured to monitor parameters such as inclination, shock and stick-slip and may transmit current values for one or more of these parameters in response to determining that the current value(s) of the one or more parameters has changed by more than a threshold amount relative to a previous value(s) for the one or more parameters. In the same apparatus an MP telemetry system may include a controller configured to monitor values for a different set of parameters such as battery voltage (or state of charge), azimuth and temperature.

In some embodiments, a control system implements a method which comprises periodically transmitting certain data on a telemetry system and conditionally transmitting other data ('conditional data') on the telemetry system. The condition may relate to a difference between a current value for the conditional data and a previous value for the conditional data and/or a comparison of the conditional data to a threshold (e.g. certain data may be transmitted if its value is lower than a threshold, other data may be transmitted if its value exceeds a threshold).

As another example, a telemetry system may be configured to transmit a certain set of data. The telemetry system may monitor priority levels of one or more sensors. The priority levels may be determined, for example, according to one or more of: a length of time since data from the sensor was last transmitted; a rate of change of the data from the sensor; a pattern of data from one or more sensors satisfying a rule; a cumulative change since data from the sensor was last transmitted; a predetermined priority level associated with the sensor (such that, for example, new data from the sensor is automatically assigned a high priority); and/or the like. In response to determining that data from one or more sensors has a priority higher than a threshold level the telemetry system may automatically insert data from the high-priority sensor(s) into a special frame or a special location in an existing frame.

A signal receiver at the surface may be configured to keep track of when each received parameter value was last updated. The signal receiver may optionally detect gaps in telemetry data where a parameter value is omitted (e.g. because control system 42 determined that the current value of a parameter is close to a most-recently transmitted value for the parameter) and/or other telemetry signals indicating that the current parameter value is not being transmitted. The signal receiver may display parameters in a manner that indicates how recently displayed values for different parameters were received (e.g. by displaying parameter values in certain colors and/or fonts and/or displaying indicia associated with the parameter values).

Such a method as well as other methods described herein may be performed using apparatus as described herein. However, such methods may also be practiced using alterative downhole apparatus comprising one or more programmed processors and/or logic circuitry suitable for implementing the method(s).

Other examples in which data may be transmitted conditionally include cases where it may be difficult or costly in terms of battery life to transmit certain data. For example, in very deep work, a system as described herein could be configured to send EM survey data in periods between active drilling only in cases where noise during active drilling may be too high for reception while drilling. This saves battery life and allows for faster surveys.

Configuration profiles may be stored in data storage 104, or in some other memory or location accessible to one or more controllers of control system 42.

Figure 5:
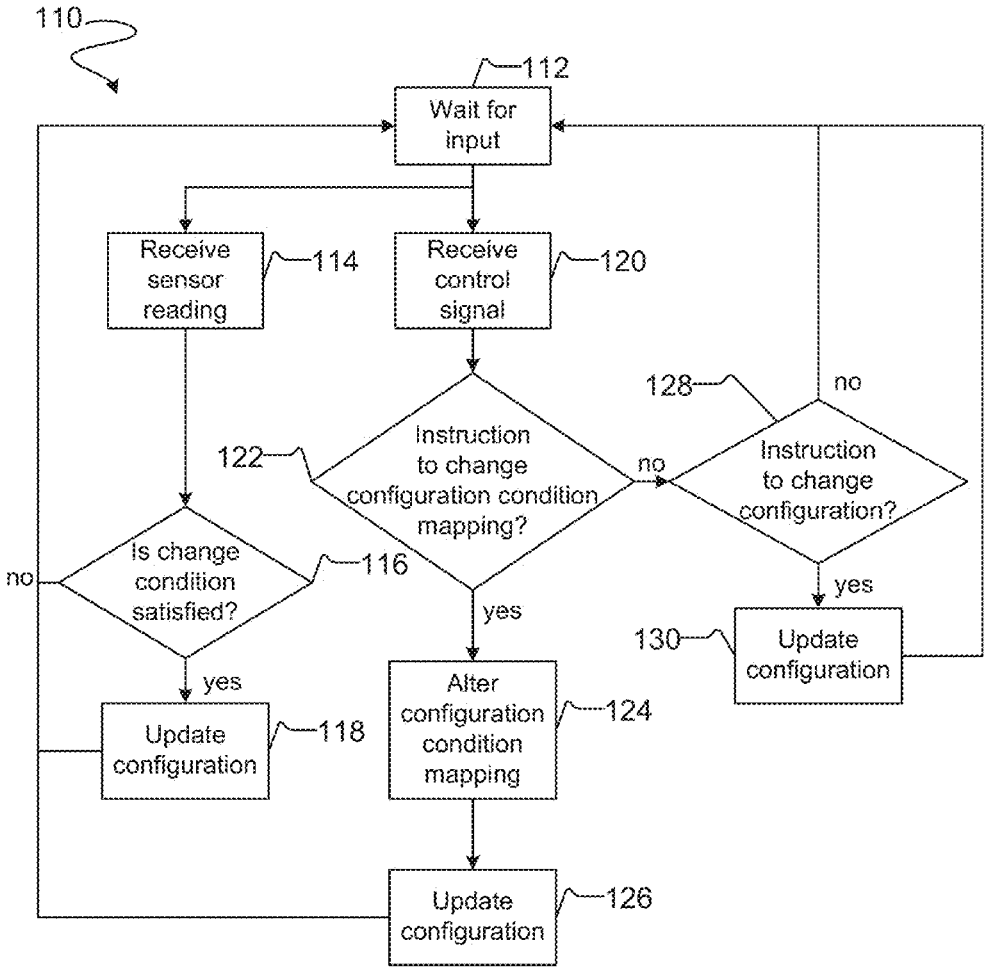
FIG. 5 is a flowchart diagram of an example method for updating a telemetry configuration system according to FIG. 4.

FIG. 5 shows an example method 110 for changing the currently active configuration profile of a telemetry system 40. Block 112 is the system state while no change is being undertaken or considered. When a sensor reading is taken, the method goes to block 114 and receives the sensor reading. The system then considers at block 116 whether a change condition has been satisfied. A change condition could be, for example, receiving a sensor reading from EM telemetry 46A indicating that the scale current is exceeding a threshold. For the sake of simplicity, and for the purpose of FIG. 5, detecting that a system, such as a telemetry system 46, has become active or inactive is included as a type of "sensor reading".

If receiving the sensor reading causes all of the change conditions associated with an inactive configuration profile to be satisfied, then the method moves to block 118, where the currently active configuration profile is changed to be the configuration profile associated with this satisfied conditions. After changing to the new configuration profile, or if no inactive configuration profile had all of its conditions satisfied, the method returns to block 112.

If a control signal is transmitted to telemetry system 40, the method goes to block 120 to receive the control signal, and then goes to decision block 122. If the received control signal encodes instructions to add, delete or alter a configuration profile (which may include adding, deleting or altering the change conditions associated with any given configuration profile), method 110 proceeds on to block 124 where those additions, deletions or alterations are incorporated by telemetry system 40. Such incorporation may be accomplished, for example, by changing values in a memory, device, structure or service (such as data storage 104) where configuration profiles and their associated change conditions are stored.

Method 110 then moves to block 126 where the current state of the system is re-evaluated so as to determine which configuration profile should be active. This process may involve, for example, comparing all of the most recently measured sensor readings against the current set of change conditions, together with the current activity or inactivity status of the various systems of telemetry system 40, and any other information used to determine the currently active configuration profile. Method 110 then returns to block 112.

If in block 122, the instruction was not one to add, delete or alter a configuration profile, then method 110 moves to block 128, where telemetry system 40 determines whether the controller signal encodes instructions to change the currently active configuration profile. If it does then method 110 moves on to block 130, where the currently active configuration profile is changed to the one indicated by the control signal.

Method 110 then moves from block 130, or if the instruction was not changed in configuration from block 128, to block 112. If the configuration was changed in response to an express instructed change to a particular configuration profile, then the telemetry system 40 may, in some embodiments, not change configuration profiles until expressly instructed to do so by a control signal. Telemetry system 40 may also, or alternatively, be configured to continue to assess sensor readings and control signals and change current configuration profiles in response thereto.

Some embodiments provide testing modes for different telemetry systems. In such a testing mode a telemetry system may be operated to transmit predetermined data for receipt and analysis at the surface.

Certain embodiments described herein offer the advantage of multiple different telemetry types and the flexibility to use different telemetry systems in different ways (examples of which are described above) in a system in which power is supplied by a common set of batteries and data is acquired by a common set of sensors accessible to each of the telemetry systems. While a downhole tool according to some embodiments may have the capability to make autonomous decisions regarding data telemetry this is not necessary in all embodiments. In simple embodiments the down hole tool may be configured to perform telemetry in a certain way or ways by loading one or more configuration files at the surface. The tool may then operate in one configuration for an entire downhole deployment or, in the alternative, may be configured to switch among two or more different configuration files in response to commands from the surface (whether transmitted by a downlink telemetry system or through predetermined patterns of operation of the drill string and/or drilling fluid system).

An advantage of some embodiments is great flexibility in that a downhole tool may be configured to perform according to the preferences of a drill rig operator. The downhole tool may be configured to use a selected single telemetry system (with all others inhibited) if that meets the operator's requirements. In other cases the downhole tool may be configured in any of the ways described above to use two or more telemetry systems, thereby providing more data of a given type, data of more different types, and/or data having higher reliability.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

Interpretation Of Terms

Unless the context clearly requires otherwise, throughout the description and the claims:

- "comprise," "comprising," and the like are to be construed in an inclusive sense, as opposed to an exclusive or exhaustive sense; that is to say, in the sense of "including, but not limited to".
- "connected," "coupled," or any variant thereof, means any connection or coupling, either direct or indirect, between two or more elements; the coupling or connection between the elements can be physical, logical, or a combination thereof.
- "herein," "above," "below," and words of similar import, when used to describe this specification shall refer to this specification as a whole and not to any particular portions of this specification.
- "or," in reference to a list of two or more items, covers all of the following interpretations of the word: any of the items in the list, all of the items in the list, and any combination of the items in the list.

the singular forms "a," "an," and "the" also include the meaning of any appropriate plural forms.

Words that indicate directions such as "vertical," "transverse," "horizontal," "upward," "downward," "forward," "backward," "inward," "outward," "vertical," "transverse," "left," "right," "front," "back"," "top," "bottom," "below," "above," "under," and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, system, assembly, device, drill string component, drill rig system, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A telemetry system comprising:

a plurality of telemetry subsystems, a control system comprising a plurality of telemetry controllers, each telemetry controller associated and in communication with at least one telemetry subsystem of the plurality of telemetry subsystems, a bus, each telemetry controller of the plurality of telemetry controllers being in communication with each other telemetry controller of the plurality of telemetry controllers via the bus, and one or more sensors in communication with the plurality of telemetry controllers, wherein:

a first telemetry controller of the plurality of telemetry controllers is configured to obtain first part sensor information from a first set of the one or more sensors and to transmit the first part sensor information on a first telemetry subsystem of the plurality of telemetry subsystems, the first telemetry subsystem comprising an EM telemetry subsystem, and a second telemetry controller of the plurality of telemetry controllers is configured to obtain second part sensor information from a second set of the one or more sensors and to transmit the second part sensor information on a second telemetry subsystem of the plurality of telemetry subsystems, the second telemetry subsystem comprising an MP telemetry subsystem;

wherein the control system is configured to monitor a drilling process that includes active drilling periods during which drilling fluid is pumped through a bore of the drillstring separated by flow-off periods during which the flow of drilling fluid through the drillstring is discontinued, and to detect the onset of one of the flow-off periods and to control the first telemetry controller to communicate the first part sensor information on the first telemetry subsystem to surface equipment in response to detecting the onset of one of the flow-off periods.

2. A system according to claim 1 wherein the control system is configured to execute a current configuration profile of the second telemetry subsystem to configure the first telemetry controller to communicate the first part sensor information on the first telemetry subsystem to surface equipment.

3. A system according to claim 2 wherein the control system is configured to detect at the surface equipment whether the second telemetry subsystem is inactive, and upon detecting that the second telemetry subsystem is inactive, switch to executing a new configuration profile to configure the first telemetry controller to communicate the first part sensor information on the first telemetry subsystem to surface equipment.

4. A system according to claim 3 wherein the control system is configured to detect whether the second telemetry subsystem is inactive by receiving one or more sensor readings from the second telemetry subsystem.

* * * * *